US008939817B2

(12) United States Patent
Son

(10) Patent No.: US 8,939,817 B2
(45) Date of Patent: Jan. 27, 2015

(54) MEMBRANE ASSEMBLY AND CARRIER HEAD HAVING THE MEMBRANE ASSEMBLY

(75) Inventor: Jun Ho Son, Gyeongbuk (KR)

(73) Assignee: K.C. Tech Co., Ltd., Anseong-si, Gyeonggi-do (KR)

( * ) Notice: Subject to any disclaimer, the term of this patent is extended or adjusted under 35 U.S.C. 154(b) by 365 days.

(21) Appl. No.: 13/482,043

(22) Filed: May 29, 2012

(65) Prior Publication Data

US 2012/0309275 A1 Dec. 6, 2012

(30) Foreign Application Priority Data

May 31, 2011 (KR) ..... 10-2011-0051797

(51) Int. Cl.
*B24B 5/02* (2006.01)
*B24B 37/30* (2012.01)
*B24B 41/06* (2012.01)

(52) U.S. Cl.
CPC ..... *B24B 37/30* (2013.01); *B24B 41/061* (2013.01)
USPC ..... 451/398; 451/288

(58) Field of Classification Search
CPC ..... B24B 37/30; B24B 41/061
USPC ..... 451/288, 290, 398
See application file for complete search history.

(56) References Cited

U.S. PATENT DOCUMENTS

| | | | | |
|---|---|---|---|---|
| 6,210,255 | B1 * | 4/2001 | Zuniga et al. | 451/41 |
| 6,244,942 | B1 * | 6/2001 | Zuniga | 451/288 |
| 6,368,189 | B1 | 4/2002 | Maloney et al. | 451/41 |
| 6,857,945 | B1 | 2/2005 | Chen et al. | 451/288 |
| 6,872,122 | B2 * | 3/2005 | Zuniga | 451/9 |
| 6,872,130 | B1 * | 3/2005 | Zuniga | 451/287 |
| 6,890,249 | B1 * | 5/2005 | Zuniga et al. | 451/398 |
| 8,083,571 | B2 | 12/2011 | Nabeya et al. | 451/9 |
| 8,100,743 | B2 * | 1/2012 | Nabeya et al. | 451/286 |
| 2002/0002025 | A1 * | 1/2002 | Chen et al. | 451/8 |
| 2002/0039879 | A1 * | 4/2002 | Zuniga et al. | 451/288 |
| 2002/0061720 | A1 * | 5/2002 | Zuniga | 451/288 |
| 2002/0086624 | A1 | 7/2002 | Zuniga et al. | 451/56 |
| 2002/0094767 | A1 * | 7/2002 | Zuniga et al. | 451/288 |
| 2002/0151260 | A1 * | 10/2002 | Crevasse et al. | 451/288 |
| 2008/0318499 | A1 * | 12/2008 | Yasuda et al. | 451/288 |
| 2013/0316628 | A1 * | 11/2013 | Jang et al. | 451/398 |

FOREIGN PATENT DOCUMENTS

| | | | |
|---|---|---|---|
| WO | WO 96/36459 | 11/1996 | B24B 37/04 |

* cited by examiner

*Primary Examiner* — Timothy V Eley
(74) *Attorney, Agent, or Firm* — Kusner & Jaffe

(57) ABSTRACT

Provided is a membrane assembly of a carrier head in a chemical-mechanical polishing apparatus. The membrane assembly includes a main membrane and a circular ring. The main membrane has a wafer contacting surface in contact with a wafer while a chemical-mechanical polishing process is being performed. The circular ring is disposed at an edge portion of the main membrane and receives an air pressure to downwardly apply the air pressure to the main membrane at the edge portion.

10 Claims, 12 Drawing Sheets

MEMBRANE ASSEMBLY AND CARRIER HEAD HAVING THE MEMBRANE ASSEMBLY

CROSS-REFERENCE TO RELATED APPLICATIONS

This U.S. non-provisional patent application claims priority under 35 U.S.C. §119 of Korean Patent Application No. 10-2011-0051797, filed on May 31, 2011, the entire contents of which are hereby incorporated by reference.

BACKGROUND

The present invention disclosed herein relates to a carrier head of a chemical-mechanical polishing apparatus, and more particularly, to a membrane assembly and a carrier having the membrane assembly, which can enlarge an active area of a wafer by pressurizing an edge portion of the wafer.

A chemical-mechanical polishing (CMP) apparatus is used for widely flattening the surface of a wafer by eliminating a height difference between a cell region and a peripheral circuit region, which is caused by an uneven wafer surface that is created by repeatedly performing a masking process, an etching process and a wiring process. Also, the CMP apparatus is used for precisely polishing the wafer surface to improve a wafer surface roughness caused by separating a contact/wiring layer for forming a circuit and highly integrating a device.

In the CMP apparatus, a carrier head holds or receives a wafer by directly and indirectly vacuum-suctioning the wafer while a polishing surface of the wafer is facing a polishing pad during a polishing process. Generally, a membrane type of carrier head is being widely used. Also, there has been proposed a multiple-region division polishing carrier head technology in which a polishing profile of the wafer can be variously controlled by locally applying different pressures on the surface of the wafer. This technology is a more advanced technology than a technology in which the surface of the wafer is uniformly polished by simply applying a uniform pressure on the surface of the wafer.

FIGS. 1A and 1B are schematic views illustrating the structure of a typical multiple-region division polishing membrane type of carrier head H and the operation state thereof when certain air pressures P1 and P2 are loaded into divided chambers C1 and C2, respectively.

As shown in FIG. 1A, a membrane 110 is installed on a bottom surface of a carrier head H. A ring-shaped membrane supporting stem 120 is integrally formed on a top surface of the membrane 110. The membrane 110 is divided into inner and outer chambers C1 and C2 by the ring-shaped membrane supporting stem 120. The membrane 110 is fixed by a membrane plate 11 and a membrane clamp 12 that are stacked inside the upper portion of the membrane 11, and a retainer ring 3 surrounding the outer circumferences of the membrane plate 11 and membrane clamp 12.

In the above-described carrier head H, when predetermined air pressures P1 and P2 are loaded through central and outer air passages 2 and 24, respectively, as shown in FIG. 1B, the air pressure P1 applies a predetermined pressure to the inner chamber C1 to allow the inner chamber C1 to expand. In addition, the air pressure P2 applies a predetermined pressure to the outer chamber C2 to allow the outer chamber C2 to expand. At this point, since an upper end of the membrane supporting stem 120 is fixed by the membrane plate 11 and the membrane clamp 12, it is not deformed by the expansion of the inner and outer chambers C1 and C2. Accordingly, a sharp circular inflexion point 121 is formed between the inner and outer chambers C1 and C2 along an outer circumference of a lower end of the membrane supporting stem 120.

The inflection point 121 has a bad influence upon performing a multiple polishing process, which is performed by a locally differential pressure load to realize a predetermined region division profile on a surface of a single wafer. That is, since a rear surface of the wafer is unstably pressurized under a sharp shape/pressure variation at a portion of the inflection point 121, the polishing speed at the region division boundary is lowered and thus an abnormal polishing phenomenon occurs. As a result, the production yield of semiconductors is reduced.

In case of the above-described typical carrier head, a wafer is adsorbed on the bottom surface of the membrane coupled to the bottom surface of the carrier head. In this case, in order to fix the wafer, an indirect suctioning method is used. For the indirect suctioning method, since a chamber vacuum pressure delivered to the wafer is relatively less than a pressure delivered to the membrane, the wafer suctioning error may occur. Thus, the wafer may be separated from the carrier head and thus damaged in the course of delivering the wafer or mounting/dismounting the wafer.

Particularly, in case of a typical carrier head membrane, since the pressure cannot be uniformly applied to the wafer adsorbed on the bottom surface of the membrane and thus the edge region of the wafer is not sufficiently polished. As a result, the whole region of the wafer including the edge region cannot be used to produce the semiconductor device, resulting in deterioration of the yield.

Meanwhile, the membranes are relatively expensive components in the carrier head but they are expendables that are partly damaged during the polishing process or cannot be used anymore after they are used for a long time. Therefore, the membranes have to be periodically replaced. However, since the membrane has a complicated structure having the fixing portion for coupling to the membrane clamp and the partition for the multiple region division polishing, the replacement of the membrane requires the assembling and disassembling of components of the carrier head. This deteriorates a life span of the carrier head and efficiency of the polishing process.

Therefore, there is a need for a membrane that can be easily replaceable with a new membrane and does not damage components of the carrier head in the course of replacing the membrane.

SUMMARY

The present invention provides a carrier head that is designed to easily suction and mount/dismount a wafer and has excellent polishing process efficiency.

The present invention also provides a membrane that can improve polishing process efficiency by applying a uniform pressure throughout a whole area of the wafer.

The present invention also provides a membrane that can be easily aligned and provide a secure close-contact.

Embodiments of the present invention provide a membrane assembly of a carrier head in a chemical-mechanical polishing apparatus, including: a main membrane having a wafer contacting surface in contact with a wafer while a chemical-mechanical polishing process is being performed; and a circular ring disposed at an edge portion of the main membrane and receiving an air pressure to downwardly apply the air pressure to the main membrane.

In some embodiments, the circular ring may have a hollow section, which is formed to have an inclined surface inclined with respect to the wafer contacting surface.

In other embodiments, the membrane assembly may further include a dividing membrane that has at least one partition for defining chambers and is disposed on a top surface of the main membrane.

In still other embodiments, the circular ring may include an outer wall that contacts an inner surface of an edge wing of the main membrane, the inclined surface that is disposed at an opposite surface of the outer wall to change the direction of the air pressure from a horizontal direction to a vertical direction, and a downward protrusion that extends downwardly from the outer wall and the inclined surface.

In even other embodiments, the main membrane may include a wing portion that vertically extends from the edge portion of the main membrane and an edge chamber extending from the wing portion, the edge chamber contacting the inclined surface so as to apply the air pressure to the inclined surface.

In yet other embodiments, the edge chamber may include an inclined portion which directly contacts the inclined surface of the circular ring.

In further embodiments, the dividing membrane may include a ring-shaped pressurizing protrusion formed on a top surface thereof.

In still further embodiments, the main membrane may include a location fixing protrusion formed at a location on the top surface thereof, corresponding to a central through hole of the dividing membrane.

In even further embodiments, the main membrane may have a thickness greater than the dividing membrane.

In yet further embodiments, the edge portion of the main membrane may include an edge wing, and the edge wing may include a protruded portion downwardly formed on inner surface thereof and providing a receiving groove.

In other embodiments of the present invention, a membrane assembly of a carrier head in a chemical-mechanical polishing apparatus includes: a main membrane providing a wafer contacting surface on a flat bottom surface thereof and comprising an edge chamber which is formed at an edge portion and receives an air pressure; and a circular ring coupled to the main membrane and having an inclined surface on a section thereof, the inclined surface receiving an air pressure from the edge chamber and turning the air pressure toward the bottom surface of the main membrane.

In some embodiments, the membrane assembly may further include a dividing membrane comprising at least one partition for providing a plurality of pressure chambers and having a flat bottom surface to be attached closely to a top surface of the main membrane.

In other embodiments, the circular ring may be formed to have a section with a hollow portion.

In still other embodiments of the present invention, a carrier head includes: a membrane assembly according to any one of the above embodiments; and an air passage for supplying a pressure to a main membrane of the membrane assembly.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF THE EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

The present invention discloses a membrane assembly including a dividing membrane, a main membrane, and a circular ring.

Figure 1A:
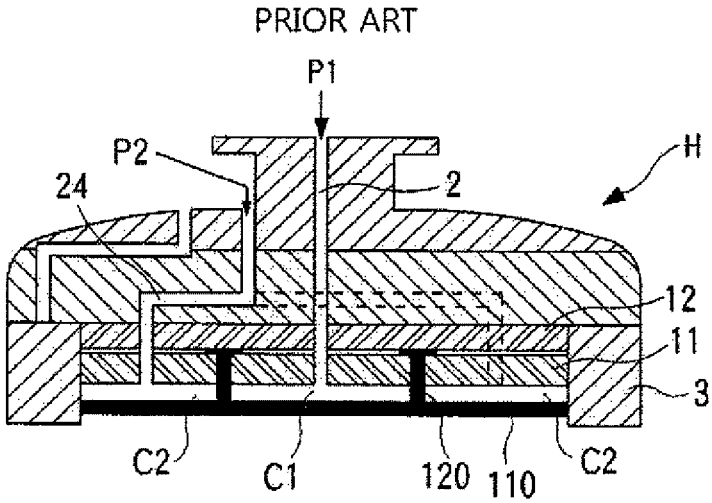
FIGS. 1A and 1B are sectionals view of a typical carrier head.
Figure 1B:
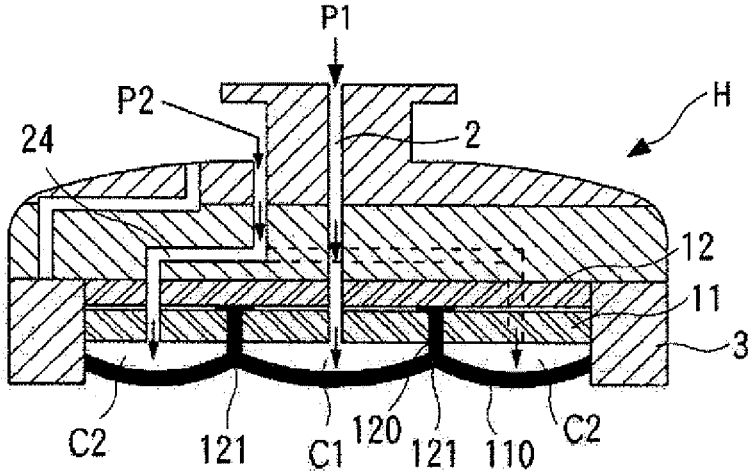
Fig. 1b PRIOR ART
Figure 2:
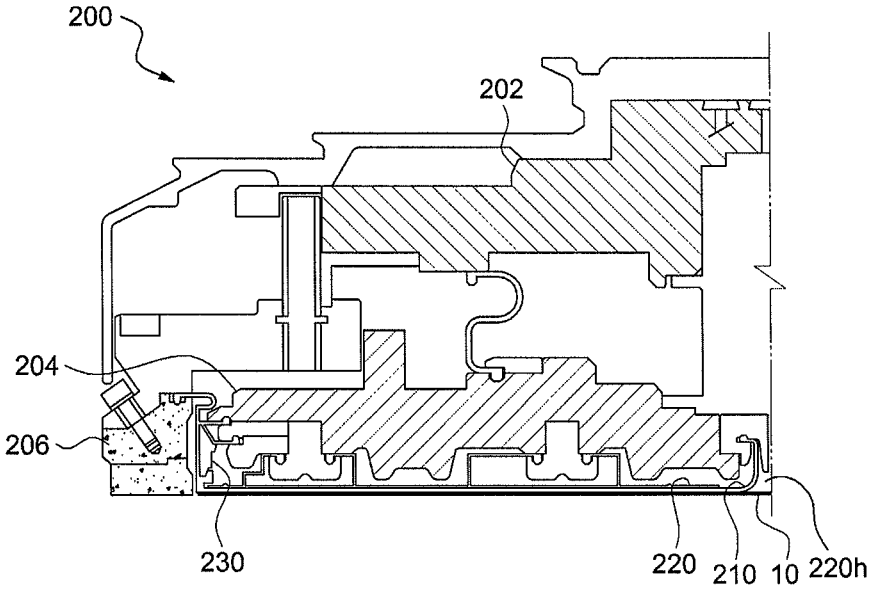
FIG. 2 is a half-sectional view of a carrier head according to an exemplary embodiment of the present invention.

FIG. 2 shows a carrier head having a membrane assembly according to an exemplary embodiment of the present invention. A carrier head 200 may include a driving unit 202 that is rotatably connected to a driving shaft (not shown). A membrane assembly having a wafer contacting surface formed inside a retainer ring 206 may be disposed on a bottom surface of the carrier head 200.

The membrane assembly may include a dividing membrane 220 that directly receives an air pressure in the carrier head 200, a main membrane 210 that closely contacts the dividing membrane 220 to indirectly receive the air pressure and has the wafer contacting surface, and a circular ring 230 that is coupled to the main membrane to apply an additional pressure to the edge portion of the wafer. The main membrane 210 and the dividing membrane 220 may be fixed on different components of the carrier head, for example, a membrane holder 206, respectively.

Figure 3:
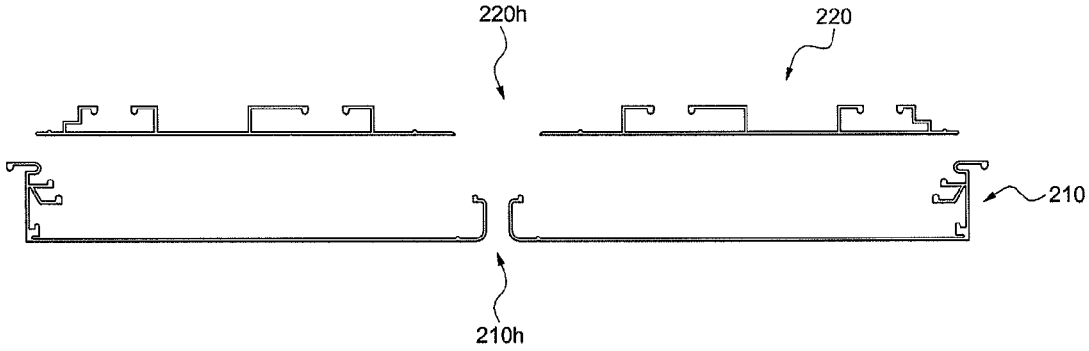
FIG. 3 is a sectional view of a dual-layer membrane of the carrier head of FIG. 2.

FIG. 3 is a sectional view of the dividing and main membranes 220 and 210 of the membrane assembly.

When viewed from the top, the dividing membrane 220 is formed in a thin disk-typed structure having a central through hole **220*h* by which an air pressure for suctioning a wafer 10 is applied. When viewed from the top, the main membrane 210 is also formed in a thin disk-typed structure having a central through hole 210*h* by which the air pressure for suctioning the wafer 10 is applied. The central through hole 210*h* has a diameter less than the central through hole 220*h***.

The membrane assembly according to the exemplary embodiment applies the air pressure through the central through hole to directly suction the wafer and can improve a polishing quality by delivering a uniform pressure to a polishing surface of the wafer.

According to another exemplary embodiment of the present invention, the dividing and main membranes of the membrane assembly may not be provided with the central through holes.

The dividing membrane 220 and the main membrane 210 may be formed of a flexible or elastic material such as a silicon rubber. The dividing membrane 220 and the main membrane 210 may be formed of a same material or different materials. While the dividing membrane 220 and the main membrane 210 are formed to be thin, they require a high hardness to remain durability in a harsh polishing process. Therefore, the hardness of the membranes may be SHORE A 40-50.

The membrane assembly is formed in a dual-layer membrane in which a bottom surface of the dividing membrane 220 closely contacts a top surface of the main membrane 210. A special coupling unit may be provided for mutual coupling and location fixing to the dividing and main membranes. In order to receive the dividing membrane, the main membrane may have a greater length than the dividing membrane.

According to the exemplary embodiment, since the membrane assembly of the carrier head is formed in the dual-layer structure having the dividing and main membranes, it becomes possible that a thickness of each of the membranes can be greatly reduced as compared with a single layer membrane. In this case, only the main membrane that is easily damaged during the polishing process can be replaced and thus the material cost can be reduced. In addition, the replacing work can be easily and economically performed.

According to the membrane assembly of the exemplary embodiment, the air pressure delivered through an air passage in the carrier head is directly applied to the dividing membrane and is indirectly applied to the main membrane to apply the pressure to the wafer.

The dividing and main membranes may be clamped to other components of the carrier head by a special unit. Alternatively, only the main membrane may be clamped while the dividing membrane is being stably disposed on the top surface of the main membrane.

Hereinafter, the membrane assembly will be described in more detail by concrete embodiments. Since the membrane assembly is symmetrical, a description thereof will be made with reference to a half-sectional view.

Figure 4:
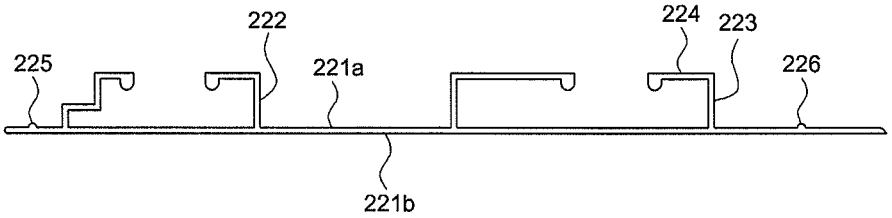
FIG. 4 is a sectional view of a dividing membrane depicted in FIG. 3.

FIG. 4 illustrates the dividing membrane. A plurality of vertical partitions 222 and 223 are formed on a top surface of the dividing membrane 220. The bottom surface of the dividing membrane 220 is flat. The partitions 222 and 223 are designed such that a multiple-region division polishing is possible by applying different air pressures to respective regions. The number, size, and location of the partitions may be varied with respect to the polishing process. Wings 224 that horizontally extend may be formed on ends of the partitions so as to clamp the dividing membrane with other components in the carrier head. A thickness of the partition may be greater than that of the dividing membrane to attain physical supporting force that can sufficiently endure the air pressure.

Pressurizing protrusions 225 and 226 are formed on the top surface of the dividing membrane. When viewed from the top, the pressurizing protrusions 225 and 226 are members formed in a ring shape. The protrusions 225 and 226 are integrally formed with the membrane assembly and locally enlarge an area to which the air pressure is applied delivered to the dividing membrane. This will be described later. The pressurizing protrusions 225 and 226 may be formed at least two locations on the top surface of the dividing membrane. For example, the pressurizing protrusion 226 may be formed at a location near the central through hole and the pressurizing protrusion 225 may be formed near an edge so that the dividing membrane can securely contact the main membrane. The protrusions may be substantially formed on a concentric circle on the top surface of the dividing membrane.

Meanwhile, although not shown in the drawings, a plurality of embossings may be formed on the top surface of the dividing membrane. The embossing makes it possible to manipulate the dividing membrane that is a thin film and to uniformly distribute the air pressure applied to the dividing membrane.

Figure 5:
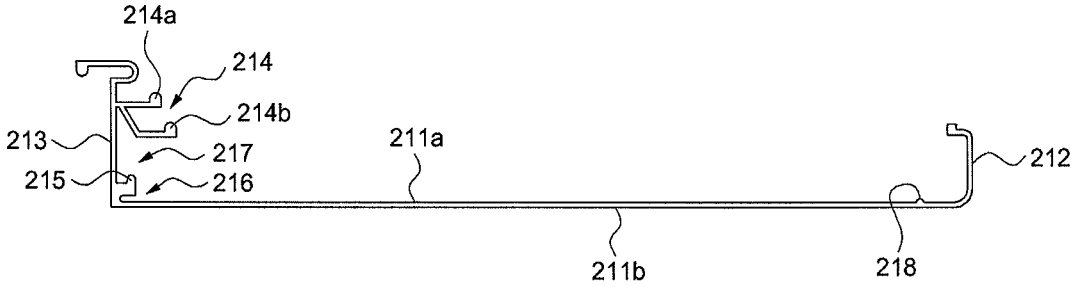
FIG. 5 is a main membrane depicted in FIG. 3.

FIG. 5 illustrates the main membrane. The top surface 211*a* of the main membrane, which provides a seating surface for the dividing membrane, is flat. Edge wings 212 and 213 are integrally formed on the central through hole portion and the edge portion to clamp the dividing membrane with other components in the carrier head. The bottom surface 211*b* of the main membrane, which provides a suctioning surface for suctioning the wafer, is flat.

The main membrane directly contacts the wafer and suctioning the wafer. Since the main membrane may be easily chemically or physically damaged, a thickness of the main membrane may be greater than that of the dividing membrane.

A protruded portion 215 provided with a receiving groove is provided on an inner surface defined by the edge wing 213 that vertically extends from the edge portion of the main membrane. An end of the dividing membrane can be inserted into the receiving groove 216. In addition, the protruded portion 215 is formed in a ring-shape that extends upward to provide another receiving groove. A circular ring is coupled in a space 217 defined by the inner surface defined by the edge wing 213 and the protruded portion 215, The main membrane is provided with an edge chamber 214 that is horizontally formed from the inner surface defined by the edge wing above the protruded portion 215. The edge chamber 214 includes upper and lower wings 214*a* and 214*b* that horizontally extend from the edge wing. The edge chamber is an independent chamber to which the air pressure is directly applied without going through the dividing membrane. The air pressure that is horizontally applied to the edge chamber changes its direction in a vertical direction through the circular ring. This will be described later.

A ring-shaped location fixing protrusion 218 may be formed near the edge wing 212 of the central through hole on the top surface of the main membrane. When the dividing member is disposed on the main membrane, the location fixing protrusion substantially corresponds to the central through hole of the dividing membrane to fix the location of the dividing membrane.

Figure 6A:
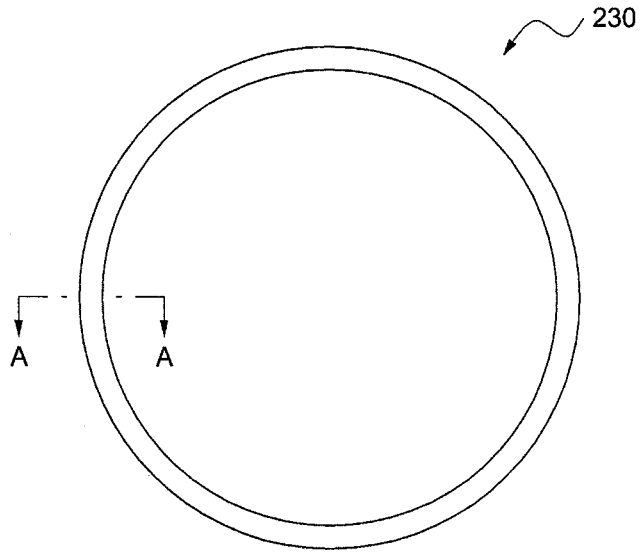
FIGS. 6A and 6B are respectively top and sectional views of a circular ring.
Figure 6B:
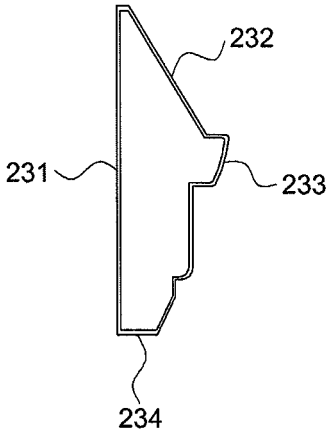

FIG. 6A is a top view of the ring of the membrane assembly and FIG. 6B is a sectional view taken along line A-A. The ring may be formed of a same material as the membrane or of an elastic material having some rigidity. The circular ring may be separately made and assembly with the main membrane. Alternatively, the circular ring may be integrally formed with the main membrane.

As shown in FIG. 6B, a section of the ring 230 is generally similar to a trapezoid. The ring 230 includes an outer wall contacting an inner surface of the edge wing 213 of the main membrane, an inclined surface 232 that is disposed at an opposite surface of the outer wall 231 to convert a horizontal pressure that is horizontally delivered into a vertical pressure, and a protrusion 233 extending under the outer wall and inclined surface. Although the ring 230 may be not provided with a hollow portion, as shown in FIG. 6*b*, the ring 230 may have a section having the hollow portion because it is more efficient to transfer the pressure received downward. A horizontal protrusion 234 that horizontally extends under the inclined surface 232. The protrusion and the horizontal protrusion function to fix the ring in the main membrane.

Figure 7:
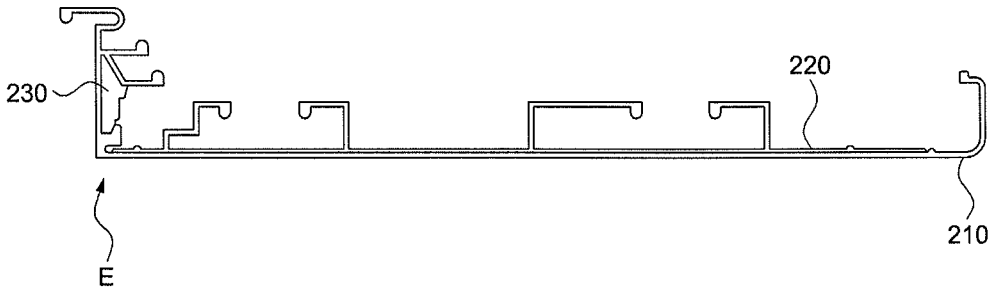
FIG. 7 is a sectional view of a membrane assembly according to an exemplary embodiment of the present invention.

FIG. 7 illustrates an assembled body formed by assembling constitutional components of the membrane assembly. An end of the dividing membrane 220 is inserted into a lower portion of the protruded portion 215 of the main membrane 210. At this point, the location fixing protrusion 218 of the main membrane 210 is inserted into the central through hole of the dividing membrane. As the ring 230 is coupled to the main membrane, the air pressure applied from the dividing membrane increases the pressure of a lower membrane edge portion E that is relatively weak.

The upper membrane and the main membrane closely contact each other by fit-coupling. The main membrane and the ring also closely contact each other by the fit-coupling. Therefore, no special coupling member and adhesive is required. Therefore, after the polishing process is completed, the main membrane, the dividing membrane, and the ring can be easily separated and they can be individually replaced with a new one.

Figure 8:
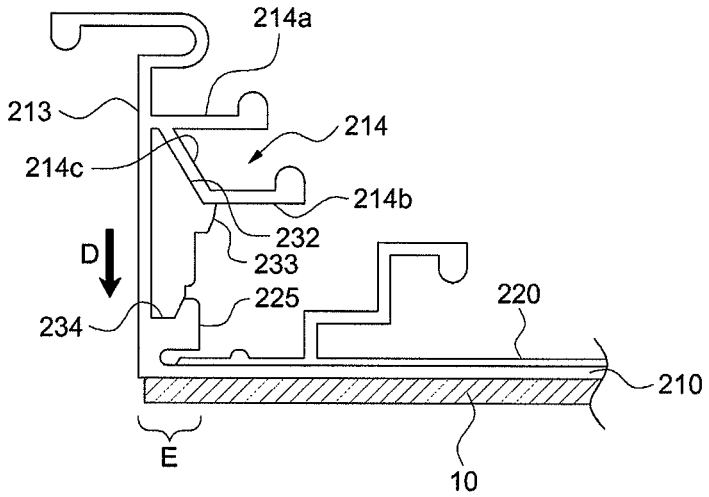
FIG. 8 is a partially enlarged view of FIG. 7.

FIG. 8 is an enlarged view illustrating the edge portion of FIG. 7. The protrusion 234 is coupled to a receiving groove above the protrusion 225 when the ring contacts the edge wing 213 of the edge portion of the main membrane. The inclined surface 232 is inserted into a rear portion of the edge chamber 214. The edge chamber includes upper and lower wings 214*a* and 214*b*. The upper wing 214*a* extends horizontally. The lower wing 214*b* includes an inclined portion 214*c* extends in an inclined state from an inner surface of the edge wing 213. A rear surface of the inclined portion 214*c* of the edge chamber directly contacts the inclined surface 232 of the ring. The horizontal protrusion 233 of the ring extends toward a horizontal portion of the lower wing of the edge chamber to prevent the ring from being separated from the lower membrane.

The air pressure delivered through the inside of the carrier head is delivered to the edge chamber as well as the respective chambers defined by the partition of the dividing membrane. An initial horizontal pressure is applied to the edge chamber and then delivered to the inclined portion 214*c* of the edge chamber to apply the inclined surface 232 of the ring. The ring transfers the pressure delivered through the inclined surface downward D. This pressure allows a large force to act on the edge region E of the wafer 10 attached on an outer surface of the main membrane. As a result, the pressure applied to the wafer in the polishing process is relatively small and thus the polishing efficiency is deteriorated, thereby allowing the edge region, which has not been used to produce the products, to be used.

Figure 9:
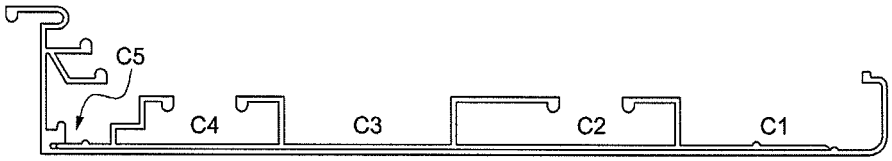
FIG. 9 is a sectional view of a multiple division chamber provided on a dividing membrane of FIG. 7.

FIG. 9 illustrates a plurality of air pressure chamber provided by the membrane assembly. A plurality of chambers C1-C5 is defined in the membrane by the vertical partition of the dividing membrane. Different pressures may be applied to the respective chambers. By supplying appropriate air pressures into the respective chambers to apply indirect pressure to the rear surface of the wafer, the precise multiple division polishing is enabled. The vertical partition defining the chambers is formed in a circular shape when viewed from the top. That is, the partitions may be disposed on a concentric circle in the dividing membrane.

Meanwhile, since the dividing membrane providing the plurality of the chambers closely contacts the top surface of the main membrane, the dividing membrane dramatically attenuates the forming of the sharp inflection point at a boundary portion of the region division polishing profile in accordance with the air pressure applied to the respective chambers during the polishing process. Accordingly, the abnormal polishing phenomenon caused by the variation of the polishing speed at the chamber boundary portion can be prevented, thereby realizing the desired polishing profile and maintaining the stable polishing speed at all regions.

In the course of the polishing process, there is a need for close-contact between the dividing membrane and the main membrane to prevent foreign substances such as air or polished sludge from being infiltrated into a contact surface between the dividing membrane and the main membrane. According to the exemplary embodiment of the present invention, since the ring-shaped pressurizing protrusion formed on the dividing membrane locally applies a greater force to the main membrane, the infiltration of the foreign substances can be sufficiently prevented.

Figure 10:
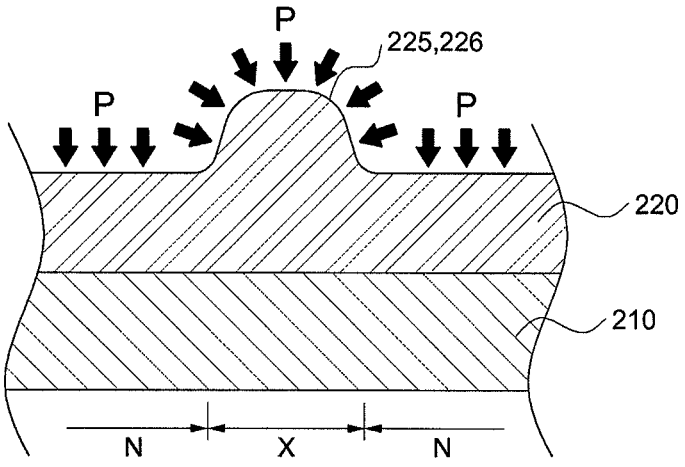
FIG. 10 is a schematic view illustrating a force applied on a pressurizing protrusion of the dividing membrane of FIG. 9.

FIG. 10 illustrates an applying process of the air pressure P to the dividing membrane when the dividing membrane 220 and the main membrane 210 form the dual-layer structure. The pressurizing protrusions protrude from the top surface of the dividing membrane to enlarge a surface area. Accordingly, when the same pressure is applied to the dividing membrane, the pressure delivered to the main membrane is greater at one region X where the pressurizing protrusion is formed than at another region N. As a result, the contact force between the dividing membrane and the main membrane is greater at the region where the pressurizing protrusion is formed. As a result, since no foreign substance is infiltrated into the contact surface between the dividing membrane and the main membrane. On the other hand, since no adhesive layer exists between opposite surfaces of the dividing and main membranes, the dividing and main membranes can be easily separated into independent membranes when the air pressure applied to the surface of the dividing membrane is removed.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A membrane assembly of a carrier head in a chemical-mechanical polishing apparatus, comprising:

a main membrane having a wafer contacting surface in contact with a wafer, a wing portion that vertically extends an edge portion of the main membrane and an edge chamber extending from the wing portion; and a circular ring disposed at an edge portion of the main membrane, the circular ring having a hollow section which is formed to have an inclined surface inclined with respect to the wafer contacting surface of the main membrane, wherein the edge chamber applies pressure to the inclined surface of the circular ring and the circular ring applies pressure to the main membrane when air pressure is applied to the edge chamber.

2. The membrane assembly of claim 1, further comprising a dividing membrane that has at least one partition for defining chambers and is disposed on a top surface of the main membrane.

3. The membrane assembly of claim 2, wherein the dividing membrane comprises a ring-shaped pressurizing protrusion formed on a top surface thereof.

4. The membrane assembly of claim 2, wherein the main membrane has a thickness greater than the dividing membrane.

5. The membrane assembly of claim 2, wherein the edge portion of the main membrane includes an edge wing, the edge wing having a protruded portion formed on an inner surface of the edge wing, and a receiving groove for receiving the dividing membrane.

6. The membrane assembly of claim 1, wherein the circular ring comprises an outer wall that contacts an inner surface of an edge wing of the main membrane, the inclined surface that is disposed at an opposite surface of the outer wall to change the direction of the air pressure from a horizontal direction to a vertical direction, and a downward protrusion that extends downwardly from the outer wall and the inclined surface.

7. The membrane assembly of claim 1, wherein the edge chamber comprises an inclined portion which directly contacts the inclined surface of the circular ring.

8. A membrane assembly of a carrier head in a chemical-mechanical polishing apparatus, comprising:

a main membrane having a wafer contacting surface in contact with a wafer, a wing portion that vertically extends from an edge portion of the main membrane and an edge chamber extending from the wing portion;

a circular ring disposed at an edge portion of the main membrane, and a dividing membrane that has at least one partition for defining chambers and is disposed on a top surface of the main membrane, wherein the edge chamber applies pressure to the circular ring and the circular ring applies pressure to the main membrane when air pressure is applied to the edge chamber and wherein the main membrane comprises a location fixing protrusion formed at a location on the top surface thereof, corresponding to a central through hole of the dividing membrane.

9. The membrane assembly of claim 8, wherein the circular ring has a hollow section which is formed to have an inclined surface inclined with respect to the wafer contacting surface of the main membrane, and wherein the edge chamber applies pressure to the inclined surface of the circular ring and the circular ring applies pressure to the main membrane when air pressure is applied to the edge chamber.

10. A carrier head comprising:

the membrane assembly of any one of claims 1, 2-6 and 7-9; and an air passage for supplying a pressure to a main membrane of the membrane assembly.

* * * * *